US010658778B2

(12) United States Patent
Hanyu

(10) Patent No.: US 10,658,778 B2
(45) Date of Patent: May 19, 2020

(54) FEMALE ELECTRICAL TERMINAL

(71) Applicant: Molex, LLC, Lisle, IL (US)

(72) Inventor: Takuji Hanyu, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/540,333

(22) PCT Filed: Dec. 7, 2015

(86) PCT No.: PCT/US2015/064291
§ 371 (c)(1),
(2) Date: Jun. 28, 2017

(87) PCT Pub. No.: WO2016/109126
PCT Pub. Date: Jul. 7, 2016

(65) Prior Publication Data

US 2018/0337480 A1 Nov. 22, 2018

(30) Foreign Application Priority Data

Dec. 29, 2014 (JP) ..... 2014-266948

(51) Int. Cl.
*H01R 13/11* (2006.01)

(52) U.S. Cl.
CPC ..... *H01R 13/112* (2013.01); *H01R 13/113* (2013.01); *H01R 13/114* (2013.01)

(58) Field of Classification Search
CPC ... H01R 13/112; H01R 13/113; H01R 13/114; H01R 13/11; H01R 13/53
(Continued)

(56) References Cited

U.S. PATENT DOCUMENTS 3,363,224 A * 1/1968 Gluntz ..... H01R 13/11 439/852
4,032,215 A * 6/1977 Jarmofsky ..... H01R 13/114 439/852
(Continued)

FOREIGN PATENT DOCUMENTS

JP S53-15582 A 2/1978
JP 2013-025988 A 2/2013
(Continued)

OTHER PUBLICATIONS

Notice of Reasons for Refusal received for JP application No. 2014-266948, dated Apr. 24, 2018, 6 pages (3 pages of english translation and 3 pages of official copy).

*Primary Examiner* — Edwin A. Leon
*Assistant Examiner* — Milagros Jeancharles
(74) *Attorney, Agent, or Firm* — Molex, LLC

(57) ABSTRACT

The female electrical terminal has a cylindrical portion able to receive a male electrical terminal inserted from front to rear, and a left wall portion arranged so that a portion of the cylindrical portion runs along the outer surface of the male electrical terminal. The left wall portion has a left plate spring portion having a contact point pressing against the outer wall of the male electrical terminal and extending forward from the rear, and a slit surrounding the outer edge of the left plate spring portion to separate the other section of the left wall portion from the outer edge of the left plate spring portion. The other section of the left wall portion has a left protruding portion positioned forward relative to the tip of the left plate spring portion and bulging inwardly into the cylindrical portion. The left protruding portion is positioned at least on the edge of the slit.

19 Claims, 6 Drawing Sheets

(58) Field of Classification Search
USPC ..... 439/851, 856, 860, 862
See application file for complete search history.

(56) References Cited

U.S. PATENT DOCUMENTS 4,076,369 A 2/1978 Ostapovitch
4,795,379 A * 1/1989 Sasaki ..... H01R 13/11 439/856
4,834,681 A * 5/1989 Chaillot ..... H01R 13/113 439/852
4,952,178 A * 8/1990 Beer ..... H01R 13/114 439/842
5,554,056 A * 9/1996 Henricus op ten Berg ..... H01R 13/112 439/857
5,630,738 A 5/1997 Ito et al.
5,741,162 A * 4/1998 Kourimsky ..... H01R 13/432 439/746
5,755,599 A 5/1998 Hotea
5,868,590 A 2/1999 Dobbelaere
5,890,936 A * 4/1999 McDonald ..... H01R 13/114 439/852
5,989,078 A * 11/1999 Chaillot ..... H01R 43/16 439/851
6,010,377 A * 1/2000 Dechelette ..... H01R 13/11 439/851
6,095,874 A * 8/2000 Quaranta ..... H01R 13/11 439/843
6,790,101 B1 * 9/2004 Data ..... H01R 13/04 439/181
7,485,016 B2 * 2/2009 Ishigami ..... H01R 4/184 439/748
7,717,759 B2 * 5/2010 Ishigami ..... H01R 4/184 439/748
D751,042 S * 3/2016 Ebisawa ..... D13/154
9,318,838 B2 * 4/2016 Karadimas ..... H01R 13/113
2005/0014422 A1 * 1/2005 Patel ..... H01R 13/114 439/851
2006/0141873 A1 * 6/2006 Casses ..... H01R 13/113 439/852
2014/0357110 A1 * 12/2014 Saito ..... H01R 13/113 439/345
2015/0050838 A1 * 2/2015 Copper ..... H01R 13/114 439/626
2016/0087366 A1 * 3/2016 Davies ..... H01R 4/184 439/818

FOREIGN PATENT DOCUMENTS

JP 2014-160544 A 9/2014
WO 2014/096886 A1 6/2014

* cited by examiner

FEMALE ELECTRICAL TERMINAL

RELATED APPLICATIONS

This application claims priority to Japanese Application No. 2014-266948, filed Dec. 29, 2014, which is incorporated herein by reference in its entirety.

TECHNICAL FIELD

The present disclosure relates to a female electrical terminal.

BACKGROUND ART

A cylinder-like female electrical terminal and a pin-like male electrical terminal are sometimes used to connect two cables. In Patent Document 1, a section of the wall portion of the male electrical terminal is a plate spring. When the male electrical terminal is inserted into the female electrical terminal, the plate spring makes contact with the outer surface of the male electrical terminal and an electrical connection is established between the two terminals.

[Patent Document 1] Laid-Open Patent Publication No. 2013-025988

SUMMARY OF THE INVENTION

As the male electrical terminal is being inserted into the female electrical terminal, the male electrical terminal is inclined relative to the female electrical terminal. As a result, the tip of the male electrical terminal strikes the tip of the plate spring in the female electrical terminal. In Patent Document 1, a protruding portion is formed in the female electrical terminal to protrude inward (the correcting portion 18 in Patent Document 1) in order to correct the position and orientation of the male electrical terminal relative to the female electrical terminal. However, in Patent Document 1, the protruding portion is formed on the front end of the female electrical terminal. When the position of the protruding portion is far from the tip of the plate spring, the tip of the male electrical terminal sometimes misses the protruding portion and strikes the tip of the plate spring.

The present disclosure provides a female electrical terminal which is able to effectively prevent the tip of a male electrical terminal from striking the tip of the plate spring in the female electrical terminal.

The present disclosure is a female electrical terminal comprising: a cylindrical portion able to receive a male electrical terminal inserted in a first direction, and a first wall portion forming a portion of the cylindrical portion and arranged so as to run along the outer surface of the male electrical terminal; the first wall portion including: a plate spring portion having a contact point pressed into the outer surface of the male electrical terminal and extending in a second direction being the direction apposite the first direction, and a slit surrounding the outer edge of the plate spring portion to divide the other section of the first wall portion from the outer edge of the plate spring portion; the other section of the first wall portion having a first protruding portion positioned in the second direction relative to the tip of the plate spring portion and bulging inwardly into the cylindrical portion, and the first protruding portion being positioned at least on the edge of the slit. In this way, the present disclosure is more effective than the prior art in preventing collisions between the tip of a male electrical terminal and the tip of the plate spring in a female electrical terminal.

The first protruding portion may bulge inwardly into the cylindrical portion relative to the section of the first wall portion positioned farther in the second direction from the edge of the slit. This creates a wider entrance in the cylindrical portion for insertion of the male electrical terminal compared to situations in which the entire portion of the slit positioned in the second direction bulges inwardly.

The first protruding portion may extend in a direction orthogonal to the first direction. In this way, the present disclosure is more effective at preventing collisions between the tip of a male electrical terminal and the tip of the plate spring in a female electrical terminal.

The other section of the first wall portion may have a second protruding portion, and the second protruding portion may be positioned relative to the plate spring portion in a direction orthogonal to the first direction and extending in the first direction. This can strengthen the portion in which the second protruding portion is arranged.

The second protruding portion may be positioned on the edge of the slit. In this way, the present disclosure is more effective at preventing collisions between the tip of a male electrical terminal and the tip of the plate spring in a female electrical terminal.

The first protruding portion and the second protruding portion may be formed along the edge of the slit and connected to each other. In this way, the present disclosure is more effective at preventing collisions between the tip of a male electrical terminal and the tip of the plate spring in a female electrical terminal.

The cylindrical portion may include a second wall portion positioned on the opposite side of the first wall portion so as to interpose the male electrical terminal, and the second wall portion may have the plate spring portion, the slit, and the first protruding portion. In this way, the present disclosure is more effective at preventing collisions between the tip of a male electrical terminal and the tip of the plate spring in a female electrical terminal.

The plate spring portion may have an end surface extending in the second direction from the tip of the plate spring portion, and the end surface of the plate spring portion may be concealed by the first protruding portion when the cylindrical portion is viewed in the first direction. In this way, the present disclosure is more effective at preventing collisions between the tip of a male electrical terminal and the tip of the plate spring in a female electrical terminal.

DETAILED DESCRIPTION OF THE PREFERRED EMBODIMENTS

Figure 1:
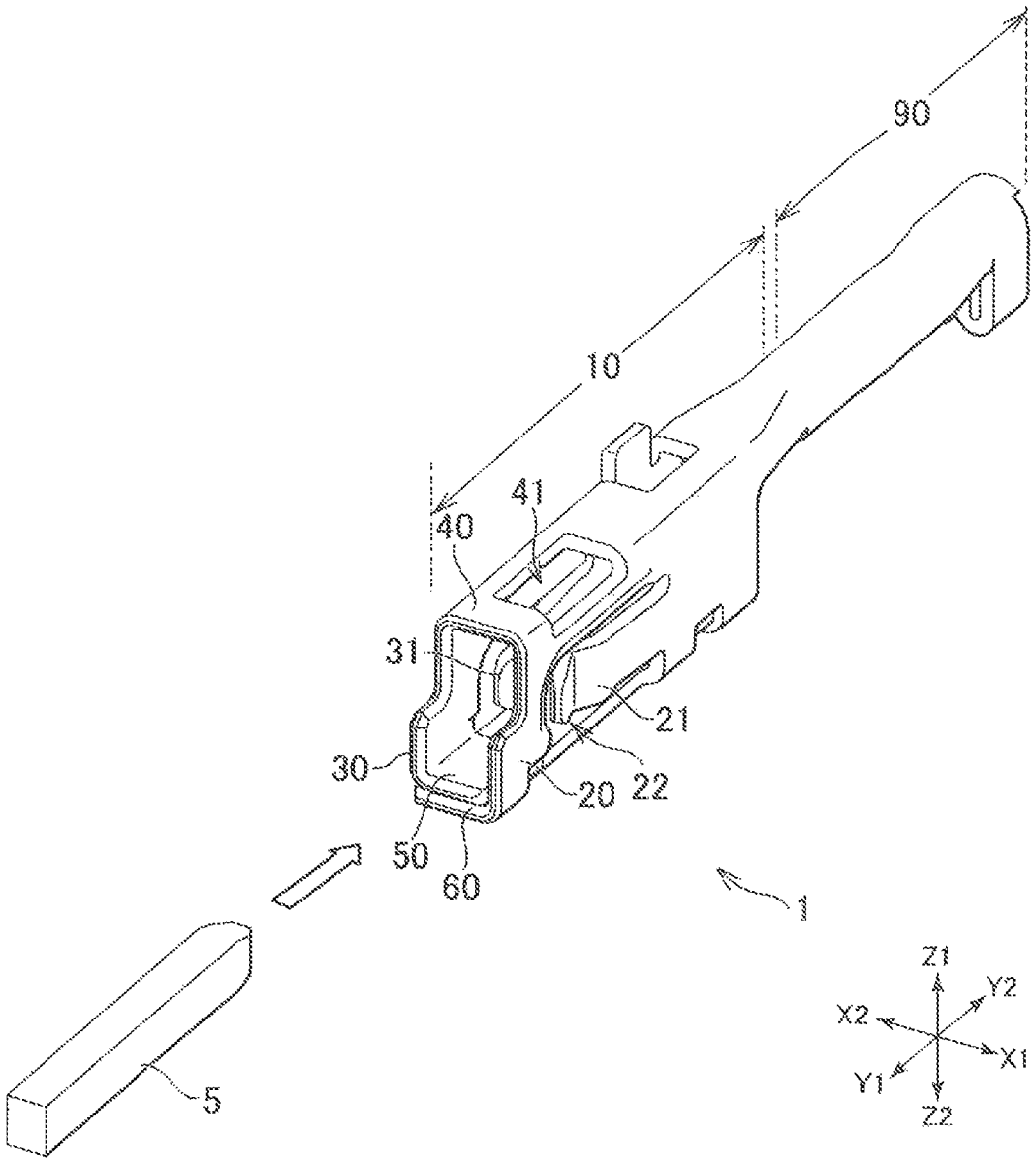
FIG. 1 is a perspective of a female electrical terminal in an embodiment the present disclosure.
Figure 2:
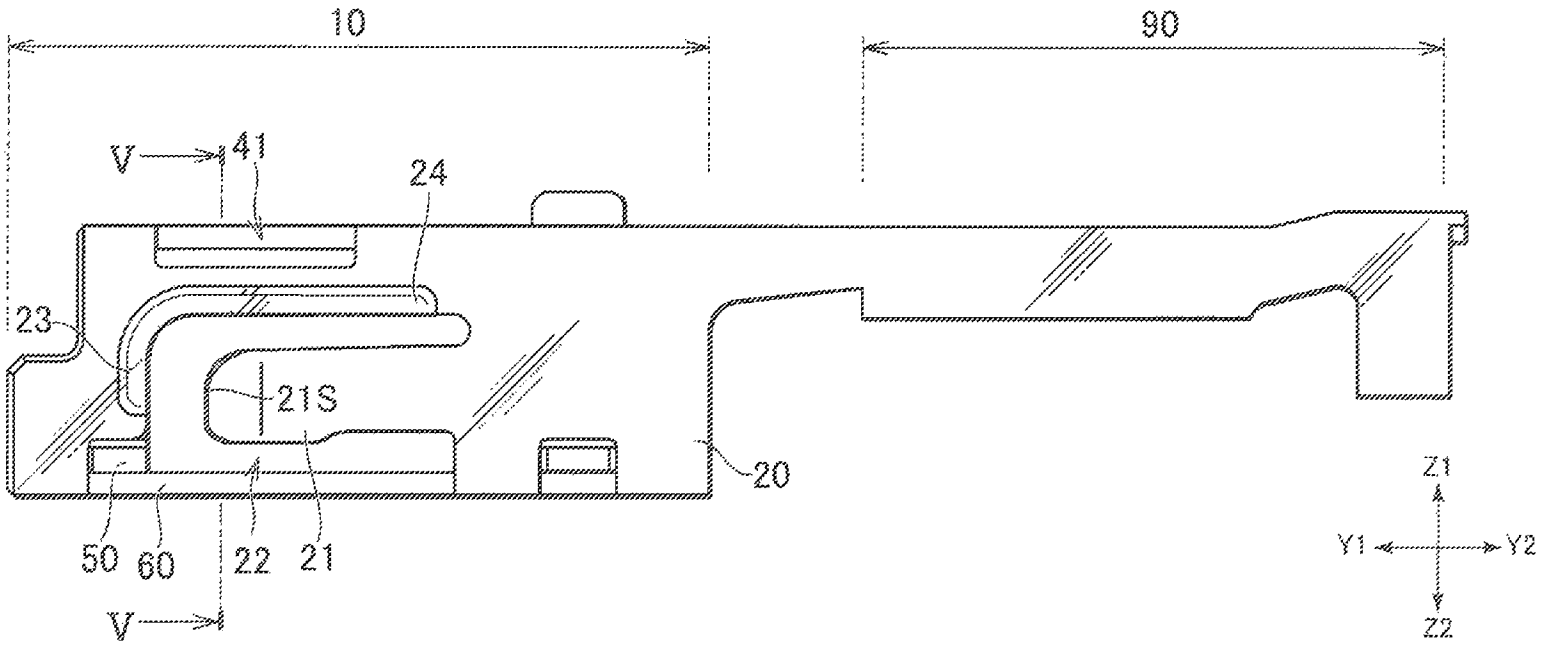
FIG. 2 is a left side view of a female electrical terminal in an embodiment of the present disclosure.
Figure 3:
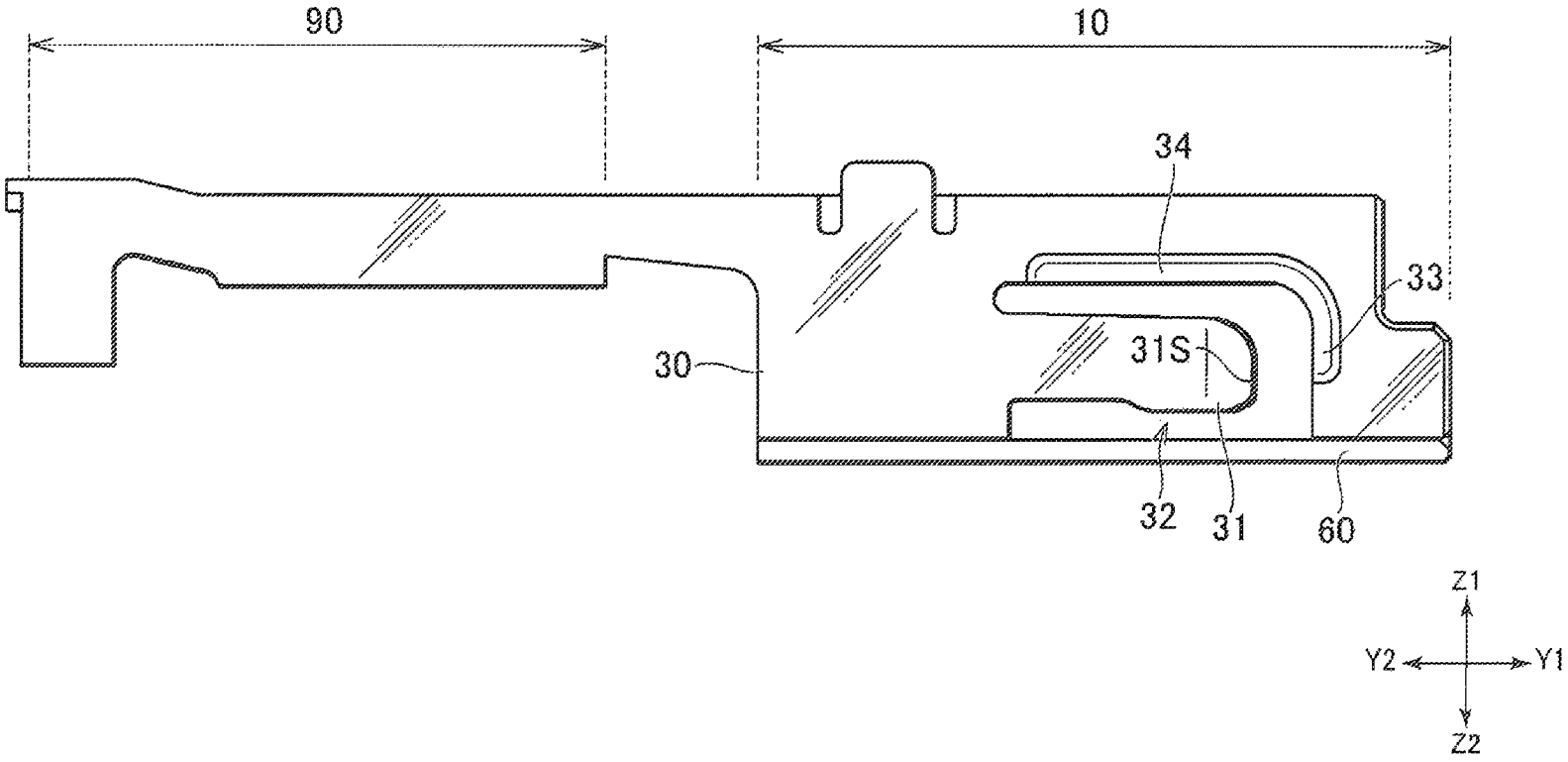
FIG. 3 is a right side view of a female electrical terminal in an embodiment of the present disclosure.
Figure 4:
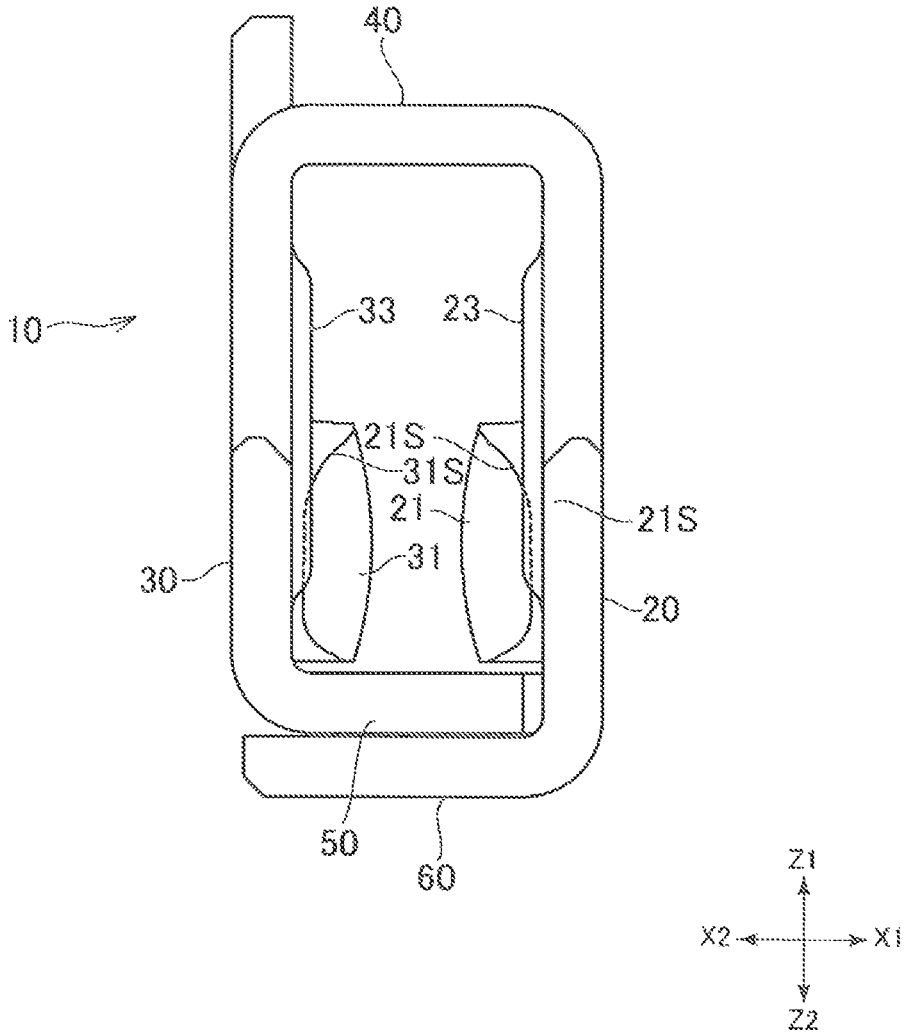
FIG. 4 is a front view of the cylindrical portion in an embodiment of the present disclosure.
Figure 5:
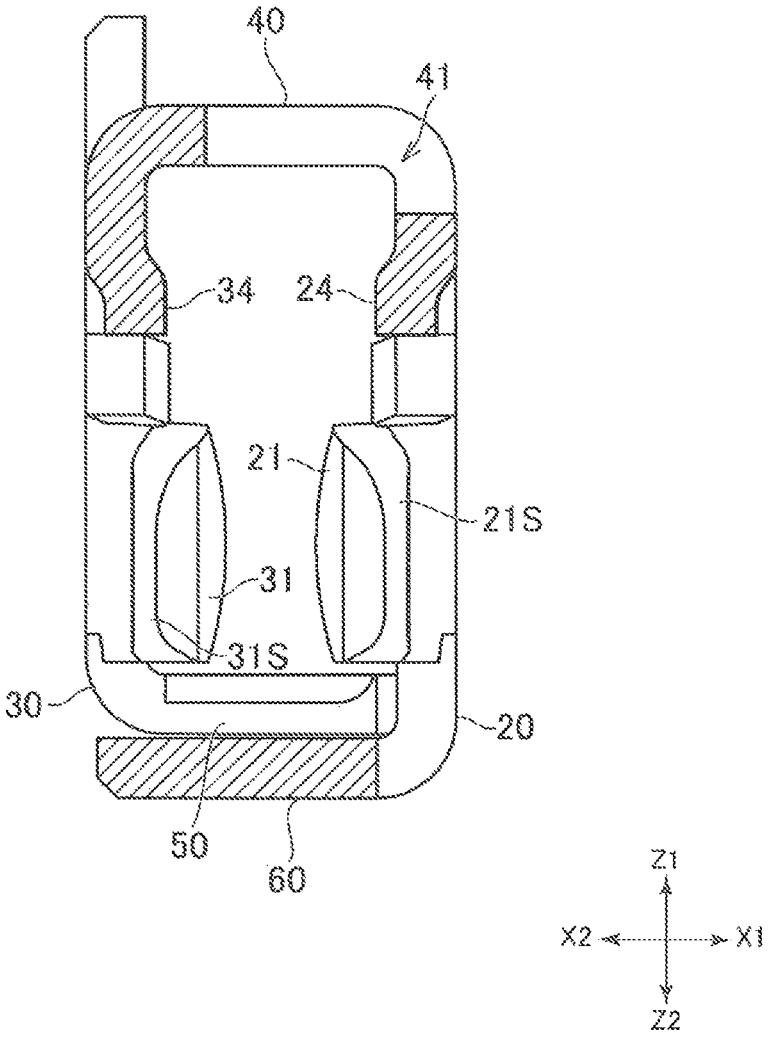
FIG. 5 is a cross-sectional view of the profile of the cylindrical portion of an embodiment of the present disclosure when viewed from the front.
Figure 6:
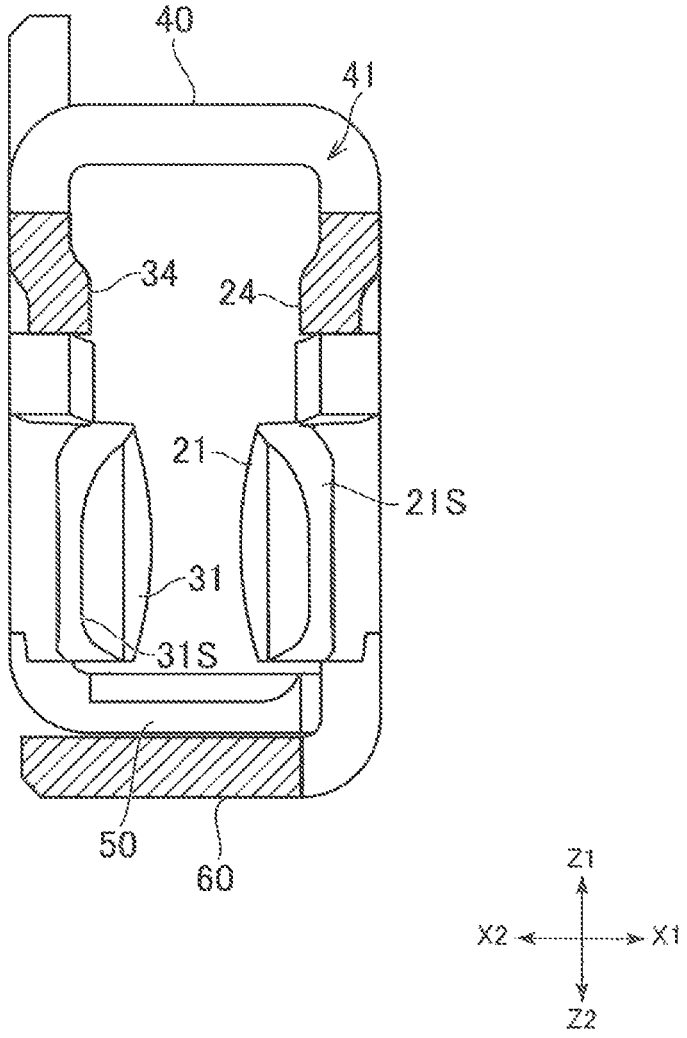
FIG. 6 is a cross-sectional view of the profile of the cylindrical portion of a variation of an embodiment of the present disclosure when viewed from the front.

The following is an explanation of an embodiment of the present disclosure (referred to below simply as the embodiment) with reference to FIG. 1 through FIG. 6. FIG. 1 is a perspective view of the female electrical terminal 1 in the embodiment, FIG. 2 is a left side view of the female electrical terminal 1 in the embodiment, FIG. 3 is a right side view of the female electrical terminal 1 in the embodiment, FIG. 4 is a front view of the cylindrical portion 10 of the female electrical terminal 1 in the embodiment, FIG. 5 is a cross-sectional view of the cylindrical portion 110 of the female electrical terminal 1 in the embodiment when viewed from V-V in FIG. 2, and FIG. 6 is a cross-sectional view of the profile of the cylindrical portion 10 of the female electrical terminal 1 in a variation of the embodiment when viewed from the front.

In the following explanation, direction X1 and direction X2 in the drawings refer, respectively, to the left direction and the right direction. Direction Y1 and direction Y2 in the drawings refer, respectively; to the forward direction and the rearward direction. Direction Z1 and direction Z2 in the drawings refer, respectively, to the up direction and the down direction.

The embodiments disclosed in the present specification are just examples of the present disclosure, and any modifications of the present disclosure easily devised by a person of skill in the art fall within the scope of the claims. Also, the widths, thicknesses, and shapes of the component shown in the drawings are represented schematically and should not be understood to limit the interpretation of the present disclosure.

As shown in FIG. 1, the female electrical terminal 1 is formed out of an electrically conductive material such as metal, and can be mounted in the housing (not shown) of a first connector (not shown) connected to an electrical component in an automobile or measuring device. The housing of the first connector is engaged with the housing (not shown) of a second connector (not shown) to establish an electrical connection between the first connector and the second connector. More specifically, pin-like male electrical terminals 5 in the housing of the second connector are inserted into female electrical terminals 1 to establish an electrical connection between the first connector and the second connector.

As shown in FIG. 1, the female electrical terminal 1 has a cylindrical portion 110 able to receive a male electrical terminal 5 inserted from front to rear, and has a crimped portion 90 connected electrically to an electric wire (not shown) such as a copper wire using crimping. The crimped portion 90 is formed with an upside-down U-shaped profile so that the left and right ends are free ends. The left and right ends are bent inwardly to interpose an electrical wire placed inside the crimped portion 90, secure the electrical wire to the female electrical terminal 1, and establish an electrical connection between the electrical wire and the female electrical terminal 1.

As shown in FIG. 1, the cylindrical portion 10 of the female electrical terminal 1 has an angular profile which is substantially rectangular in cross section, a left wall portion 20 arranged on the left side, a right wall portion 30 arranged on the right side, and an upper wall portion 40 arranged on the top side. The cylindrical portion 10 is formed by bending a flat electrically conductive material so that it overlaps on the bottom of the cylindrical portion 10. More specifically, it is formed so that an inner lower wall portion 50 overlaps on the inside of the cylindrical portion 10, and an outer lower wall portion 60 overlaps on the outside. The left wall portion 20, the right wall portion 30, the upper wall portion 40, the inner lower wall portion 50, and the outer lower wall portion 60 are arranged so as to run along the outer surface of the male electrical terminal 5 when it has been inserted into the female electrical terminal 1.

Here, as shown in FIG. 1 and FIG. 2, a left plate spring portion 21 is formed in the left wall portion 20 positioned on the left side of the female electrical terminal 1, and a slit 22 is formed to surround the outer edge of the left plate spring portion 21. This slit 22 separates the left plate spring portion 21 from the rest of the left wall portion 20 excluding the left plate spring portion 21.

The left plate spring portion 21 is formed longitudinally in the forward direction from the rear. Also, the left plate spring portion 21 inclines into the cylindrical portion 10 as it moves forward, and has a contact portion near the tip which presses against the outer surface of the male electrical terminal 5. The tip of the left plate spring portion 21 is elastically deformable to the left, and the contact point of the left plate spring portion 21 and the contact point on the right plate spring portion 31 described below make contact with the interposed male electrical terminal 5 inserted into the cylindrical portion 10. The left plate spring portion 21 is bent forward from the contact point and is inclined outward from the cylindrical portion 10.

As shown in FIG. 2, the left wall portion 20 also has a left forward protruding portion 23 positioned in front of the tip of the left plate spring portion 21 and bulges into the cylindrical portion 10. The left forward protruding portion 23 is arranged so as to extend vertically at least on the edge of the slit 22 (that is, longitudinally).

More specifically, the left forward protruding portion 23 is formed on the edge of the slit 22 and bulges into the cylindrical portion 10 relative the portion of the left wall portion 20 positioned in front of the edge of the slit 22, This creates a wider entrance in the cylindrical portion 10 for insertion of the male electrical terminal 5 compared to situations in which the entire portion of the slit 22 positioned in the forward direction bulges inwardly.

The left forward protruding portion 23 is press-formed so that the left forward protruding portion 23 is not formed a certain distance from the lower end of the edge in front of the slit 22. By providing a region in which the left forward protruding portion 23 is not formed, the complexity of the process can be reduced. The left forward protruding portion 23 does not have to be press-formed. Any other method can be used.

As shown in FIG. 2, the left wall portion 20 also has a left upward protruding portion 24. The left upward protruding portion 24 is arranged so as to extend longitudinally (that is, horizontally) and upward relative to the left plate spring portion 21.

More specifically, the left upward protruding portion 24 is formed on the edge of the slit 22, and constitutes a continuation of the protruding portion by connecting the left forward protruding portion 23 to the left upward protruding portion 24. In other words, the left forward protruding portion 23 and the left upward protruding portion 24 surround the left plate spring portion 21 in front and above.

As shown in FIG. 1 and FIG. 3, the right wall portion 30 located on the right side of the female electrical terminal 1 has a right plate spring portion 31 having a function and shape identical to those of the left plate spring portion 21 and a slit 32 surrounding the outer edge of the right plate spring portion 31. As shown in FIG. 3, the right wall portion 30 has a right forward protruding portion 33 positioned in front of the tip of the right plate spring portion 31 and bulges into the cylindrical portion 10. The right forward protruding portion 33 is arranged so as to extend vertically at least on the edge of the slit 32 (that is, longitudinally).

As shown in FIG. 3, the right wall portion 30 also has a right upward protruding portion 34 positioned above the right plate spring portion 31 and bulging into the cylindrical portion 10. The right upward protruding portion 34 is arranged so as to extend longitudinally and upward (that is, horizontally) on the edge of the slit 32. The right forward protruding portion 33 and the right upward protruding portion 34 are connected to each other to form a continuous protruding portion.

Here, as shown in FIG. 4, the left forward protruding portion 23 and the right forward protruding portion 33 bulge into the cylindrical portion 10. When the cylindrical portion 10 is viewed from the front as shown in FIG. 4, the end surface 21S constituting the tip of the left plate spring portion 21 is concealed by the left forward protruding portion 23. More specifically, the left forward protruding portion 23 protrudes into the cylindrical portion 10 from the end surface 21S. In other words, the width of the left forward protruding portion 23 is greater than the width of the end surface 21S in the transverse direction. The end surface 31S constituting the tip of the right, plate spring portion 31 is concealed by the right forward protruding portion 33 in a similar manner.

When the left forward protruding portion 23 and the right forward protruding portion 33 are formed in this manner, the left forward protruding portion 23 (or right forward protruding portion 33) press against the tip of a male electrical terminal 5 inserted into the cylindrical portion 10 on an incline, causing it to evade the end surface 21S of the left plate spring portion (or the end surface 31S of the right plate spring portion) as it travels towards the rear of the cylindrical portion 10. As a result, a collision with the end surface 21S can be prevented. Also, because the left forward protruding portion 23 and the right forward protruding portion 33 are each positioned longitudinally in the section nearest the plate spring portions, avoidance of a collision is more reliable.

Because the left forward protruding portion 23 and the left upward protruding portion 24 are connected and surround the region directly adjacent to the left plate spring portion 21 both on top and in front, a collision between the male electrical terminal 5 and the end surface 21S of the left plate spring portion can be avoided even more reliably. Similarly because the right forward protruding portion 33 and the right upward protruding portion 34 are connected and surround the region directly adjacent to the right plate spring portion 31 both on top and in front, a collision between the male electrical terminal 5 and the end surface 31S of the right plate spring portion can be avoided even more reliably.

As shown in FIG. 1, an opening 41 is formed in the upper wall portion 40 of the female electrical terminal 1. This opening 41 is designed to engage a securing portion (not shown) such as a hook or spring formed in the female housing in order to secure the female electrical terminal 1 inside the female housing. Here, the opening 41 is preferably provided widthwise in order to more reliably engage the securing portion of the female housing. In the present embodiment, as shown in FIG. 1 and FIG. 5, the opening 41 is shifted to the left from the center of the upper wall portion 40 so as to jut into the left wall portion 20.

When the opening 41 is shifted to the left from the center of the upper wall portion 40, there is concern that the terminal has less resistance to external impacts because the vertical width is narrower from the left edge of the opening 41 to the upper edge of the slit 22 (see FIG. 2). However, because a left upward protruding portion 24 is formed on the upper edge of the slit 22 which bulges into the cylindrical portion 10, the strength of the left upper portion remains above a sufficient level. Also, because the right upward protruding portion 34 formed on the upper edge of the slit 32 in the right wall portion 30 bulges into the cylindrical portion 10, the strength of the right upper portion of the cylindrical portion 10 is even greater than the prior art.

The present disclosure is not limited to the embodiment described above. Many variations are possible within the scope of the present disclosure. The following is an explanation of another embodiment of the present disclosure (variation).

In the embodiment described above, the left forward protruding portion 23 was formed on the edge of the slit 22 in the left wall portion 20. However, the left forward protruding portion 23 can also be formed from the edge of the slit 22 to the forward tip of the cylindrical portion 10. In other words, the left wall portion 20 can bulge inwardly from the edge of the slit 22 forward on the cylindrical portion 10.

In this situation, the right forward protruding portion 33 is also formed from the edge of the slit 32 to the forward tip of the cylindrical portion 10 in the right wall portion 30. In other words, the right wall portion 30 can bulge inwardly from the edge of the slit 22 forward on the cylindrical portion 10.

In the embodiment explained above, the left upward protruding portion 24 was formed above the left plate spring portion 21 in the left wall portion 20. However, the left wall portion 20 may be formed so as to be wider below the left plate spring portion 21 and the slit 22. Here, a left downward protruding portion (not shown) having a shape extending longitudinally (horizontally) and bulging into the cylindrical portion 10 is formed below the left plate spring portion 21. As a result, resistance of the cylindrical portion 10 to external impacts from the lower left is greater than that of the prior art.

Here, the left lower protruding portion may be formed so as to connect to the lower end of the left forward protruding portion 23 and surround the left plate spring portion 21 from below. Because the region directly adjacent to the left plate spring portion 21 is surrounded in front and below, collisions between the end surface 21S of the left plate spring portion and the male electrical terminal 5 can be more reliably prevented.

In the right wall portion 30, as in the left wall portion 20, a right downward protruding portion (not shown) similar to the left downward protruding portion is formed below the right plate spring portion 31 and the slit 32. Also, the right lower protruding portion may be formed so as to connect to the lower end of the right forward protruding portion 33 and surround the right plate spring portion 31 from below. This improves the strength of the cylindrical portion 10 on the lower right, and prevents collisions between the end surface 31S of the right plate spring portion and the male electrical terminal 5.

In the embodiment described above, the opening 41 is shifted to the left from the center of the upper wall portion 40. However, the opening 41 may be shifted to the right so as to jut into the right wall portion 30. As shown in FIG. 6, the terminal may also be widened on both sides so that the opening may jut into both the left wall portion 20 and the right wall portion 30. In this situation, there may be some concern that the vertical section from the right edge of the opening 41 to the upper edge of the slit 32 is weaker than the embodiment described above. However, because a right forward protruding portion 34 is formed on the upper edge of the slit 32, the upper strength of the right wall portion 30 remains above a sufficient level.

The invention claimed is:

1. A female electrical terminal comprising:

a crimped portion configured to be connected to an electric wire; and a cylindrical portion positioned forward of the crimped portion, the cylindrical portion configured to receive a male electrical terminal in a front-to-rear direction, the cylindrical portion having at least one side wall portion having a front end, the at least one side wall portion having a slit formed therein which separates the at least one side wall portion into first and second sections, the first section being a plate spring portion that is formed as a cantilevered beam, the second section being positioned forward of, and above, the plate spring portion, the second section having a forward protruding portion defined along at least a portion of a forward edge of the slit and an upward protruding portion defined along at least a portion of an upward edge of the slit, each of the forward protruding portion and the upward protruding portion being configured to bulge inwardly into the cylindrical portion, wherein, in operation, upon the male electrical terminal being received in the cylindrical portion, the forward protruding portion is configured to engage the male electrical terminal before the plate spring portion is configured to engage the male electrical terminal.

2. A female electrical terminal comprising:

a crimped portion configured to be connected to an electric wire; and a cylindrical portion positioned forward of the crimped portion, the cylindrical portion configured to receive a male electrical terminal in a front-to-rear direction, the cylindrical portion having at least one side wall portion having a front end, the at least one side wall portion having a slit formed therein which separates the at least one side wall portion into first and second sections, the slit having a closed forward edge which is bounded by the second section, the first section being a plate spring portion that is formed as a cantilevered beam, the second section being positioned forward of, and above, the plate spring portion, the second section having a forward protruding portion defined along at least a portion of the forward edge of the slit, the forward protruding portion configured to bulge inwardly into the cylindrical portion, the forward edge of the slit being positioned rearward of the front end of the at least one side wall portion, wherein, in operation, upon the male electrical terminal being received in the cylindrical portion, the forward protruding portion is configured to engage the male electrical terminal before the plate spring portion is configured to engage the male electrical terminal, and wherein the second section has an upward protruding portion defined along at least a portion of an upper edge of the slit, the upward protruding portion configured to bulge inwardly into the cylindrical portion.

3. The female electrical terminal as defined in claim 2, wherein the at least one side wall portion comprises a left side wall portion and a right side wall portion.

4. The female electrical terminal as defined in claim 3, wherein the cylindrical portion has an upper wall portion and a lower wall portion, the left and right side wall portions extending between the upper and lower wall portions.

5. The female electrical terminal as defined in claim 4, wherein the lower wall portion has an inner lower wall portion and an outer lower wall portion which overlap each other, the inner lower wall portion extending from one of the left and right side wall portions, the outer lower wall portion extending from the other one of the left and right side wall portions.

6. The female electrical terminal as defined in claim 5, wherein the upper wall portion has a front end, wherein the upper wall portion does not have a slit which extends in the front-to-rear direction from the front end thereof toward the crimped portion.

7. The female electrical terminal as defined in claim 4, wherein the upper wall portion has an opening formed therein.

8. The female electrical terminal as defined in claim 7, wherein the opening is positioned proximate to one of the left and right side wall portions and distal from the other one of the left and right side wall portions.

9. The female electrical terminal as defined in claim 7, wherein the crimped portion extends rearwardly from the upper wall portion.

10. The female electrical terminal as defined in claim 7, wherein the opening is further formed in one of the left and right side wall portions.

11. The female electrical terminal as defined in claim 4, wherein the crimped portion extends rearwardly from the upper wall portion.

12. The female electrical terminal as defined in claim 4, wherein the upper and lower wall portions having front ends, wherein the upper and lower wall portions do not have slits, respectively, which extend in the front-to-rear direction from the front ends thereof toward the crimped portion.

13. The female electrical terminal as defined in claim 2, wherein the forward protruding portion and the upward protruding portion are connected to one another in a generally L-shaped configuration.

14. The female electrical terminal as defined in claim 2, wherein the plate spring portion has a forward free end having an end surface, and wherein when the cylindrical portion is viewed from a front, the end surface is concealed by the forward protruding portion.

15. The female electrical terminal as defined in claim 2, wherein the forward protruding portion is positioned rearward of the front end of the at least one side wall portion.

16. A female electrical terminal comprising:

a crimped portion configured to be connected to an electric wire; and a cylindrical portion positioned forward of the crimped portion, the cylindrical portion configured to receive a male electrical terminal in a front-to-rear direction, the cylindrical portion having at least one side wall portion having a front end, the at least one side wall portion having a slit formed therein which separates the at least one side wall portion into first and second sections, the slit having a closed forward edge which is bounded by the second section, the first section being a plate spring portion that is formed as a cantilevered beam, the second section being positioned forward of, and above, the plate spring portion, the second section having a forward protruding portion defined along at least a portion of the forward edge of the slit, the forward protruding portion configured to bulge inwardly into the cylindrical portion, the forward edge of the slit being positioned rearward of the front end of the at least one side wall portion, wherein, in operation, upon the male electrical terminal being received in the cylindrical portion, the forward protruding portion is configured to engage the male electrical terminal before the plate spring portion is configured to engage the male electrical terminal, wherein the at least one side wall portion comprises a left side wall portion and a right side wall portion, wherein the cylindrical portion has an upper wall portion and a lower wall portion, the left and right side wall portions extending between the upper and lower wall portions, wherein the upper wall portion has an opening formed therein, wherein the opening is positioned proximate to one of the left and right side wall portions and distal from the other one of the left and right side wall portions, wherein the opening is positioned proximate to the left side wall portion and distal from the right side wall portion, and wherein the second section has an upward protruding portion defined along at least a portion of an upper edge of the slit, the upward protruding portion configured to bulge inwardly into the cylindrical portion.

17. The female electrical terminal as defined in claim 16, wherein the forward protruding portion and the upward protruding portion are connected to one another in a generally L-shaped configuration.

18. A female electrical terminal comprising:

a crimped portion configured to be connected to an electric wire; and a cylindrical portion positioned forward of the crimped portion, the cylindrical portion configured to receive a male electrical terminal in a front-to-rear direction, the cylindrical portion having at least one side wall portion having a front end, the at least one side wall portion having a slit formed therein which separates the at least one side wall portion into first and second sections, the slit having a closed forward edge which is bounded by the second section, the first section being a plate spring portion that is formed as a cantilevered beam, the second section being positioned forward of, and above, the plate spring portion, the second section having a forward protruding portion defined along at least a portion of the forward edge of the slit, the forward protruding portion configured to bulge inwardly into the cylindrical portion, the forward edge of the slit being positioned rearward of the front end of the at least one side wall portion, wherein, in operation, upon the male electrical terminal being received in the cylindrical portion, the forward protruding portion is configured to engage the male electrical terminal before the plate spring portion is configured to engage the male electrical terminal, wherein the at least one side wall portion comprises a left side wall portion and a right side wall portion, wherein the cylindrical portion has an upper wall portion and a lower wall portion, the left and right side wall portions extending between the upper and lower wall portions, wherein the upper wall portion has an opening formed therein, wherein the opening is further formed in one of the left and right side wall portions, and wherein a forward edge of the opening is approximately planar with the forward edge of the slit, and wherein a rearward edge of the opening is forward of a rearward edge of the slit.

19. A female electrical terminal comprising:

a crimped portion configured to be connected to an electric wire; and a cylindrical portion positioned forward of the crimped portion, the cylindrical portion configured to receive a male electrical terminal in a front-to-rear direction, the cylindrical portion having at least one side wall portion having a front end, the at least one side wall portion having a slit formed therein which separates the at least one side wall portion into first and second sections, the slit having a closed forward edge which is bounded by the second section, the first section being a plate spring portion that is formed as a cantilevered beam, the second section being positioned forward of, and above, the plate spring portion, the second section having a forward protruding portion defined along at least a portion of the forward edge of the slit, the forward protruding portion configured to bulge inwardly into the cylindrical portion, the forward edge of the slit being positioned rearward of the front end of the at least one side wall portion, wherein, in operation, upon the male electrical terminal being received in the cylindrical portion, the forward protruding portion is configured to engage the male electrical terminal before the plate spring portion is configured to engage the male electrical terminal, wherein the at least one side wall portion comprises a left side wall portion and a right side wall portion, wherein the cylindrical portion has an upper wall portion and a lower wall portion, the left and right side wall portions extending between the upper and lower wall portions, wherein the upper wall portion has an opening formed therein, wherein the opening is further formed in one of the left and right side wall portions, and wherein a portion of the second section separates a lower edge of the opening from an upper edge of the slit.

* * * * *